United States Patent [19]

Clark

[11] Patent Number: 4,747,452

[45] Date of Patent: May 31, 1988

[54] WELLBORE CLEANING DEVICE

[75] Inventor: David A. Clark, Ponca City, Okla.

[73] Assignee: Conoco Inc., Ponca City, Okla.

[21] Appl. No.: 913,782

[22] Filed: Sep. 30, 1986

[51] Int. Cl.[4] ..... E21B 37/00

[52] U.S. Cl. ..... 166/311; 166/173; 166/241; 15/104.12

[58] Field of Search ..... 166/311, 70, 170–174, 166/241; 175/61, 102, 313, 325; 15/104.12, 104.01 R, 104.16, 104.02, 104.06 R

[56] References Cited

U.S. PATENT DOCUMENTS

| | | | |
|---|---|---|---|
| 271,358 | 1/1883 | Pike . | |
| 304,470 | 9/1884 | Thomas . | |
| 574,422 | 1/1897 | Hildreth . | |
| 595,780 | 12/1897 | Krisan . | |
| 705,753 | 7/1902 | Hart | 15/104.12 |
| 712,487 | 11/1902 | Black | 175/325 |
| 1,049,761 | 1/1913 | Perkins | 175/325 X |
| 1,372,308 | 3/1921 | MacRae . | |
| 1,855,046 | 4/1932 | Gerhardt | 166/170 X |
| 1,893,020 | 1/1933 | Cushing | 175/325 |
| 2,162,677 | 6/1939 | Reynolds | 15/104.12 X |
| 2,166,937 | 7/1939 | Bettis | 255/28 |
| 2,579,813 | 12/1951 | Frank | 15/104.05 |
| 3,827,492 | 8/1974 | Hammon et al. | 166/173 |
| 4,216,738 | 8/1980 | Muta | 15/104.12 X |
| 4,438,812 | 3/1984 | Hammon | 166/173 |
| 4,501,322 | 2/1985 | Martin | 166/173 |

FOREIGN PATENT DOCUMENTS

| | | | |
|---|---|---|---|
| 0642025 | 1/1979 | U.S.S.R. | 15/104.12 |

*Primary Examiner*—Stephen J. Novosad
*Assistant Examiner*—David J. Bagnell
*Attorney, Agent, or Firm*—Richard K. Thomson

[57] ABSTRACT

Method and apparatus for cleaning out a cased or uncased wellbore (particularly a high angle wellbore) prior to running a(nother) string of casing, a logging tool, or the like, into the hole. A stiff-bristled scouring brush is run in the hole on the leading end of a drill string. The brush is rotated as it is advanced through the portion to be cleaned to enhance dislodgement of caked on cuttings, drilling mud, and the like. Drilling fluid is reverse-circulated down the casing to entrain the dislodged material and carry it uphole in the high-velocity stream inside the drill string. A centering dolly keeps the apparatus positioned in the wellbore and keeps the weight of the drill string from riding on the brush.

20 Claims, 2 Drawing Sheets

FIG. 1
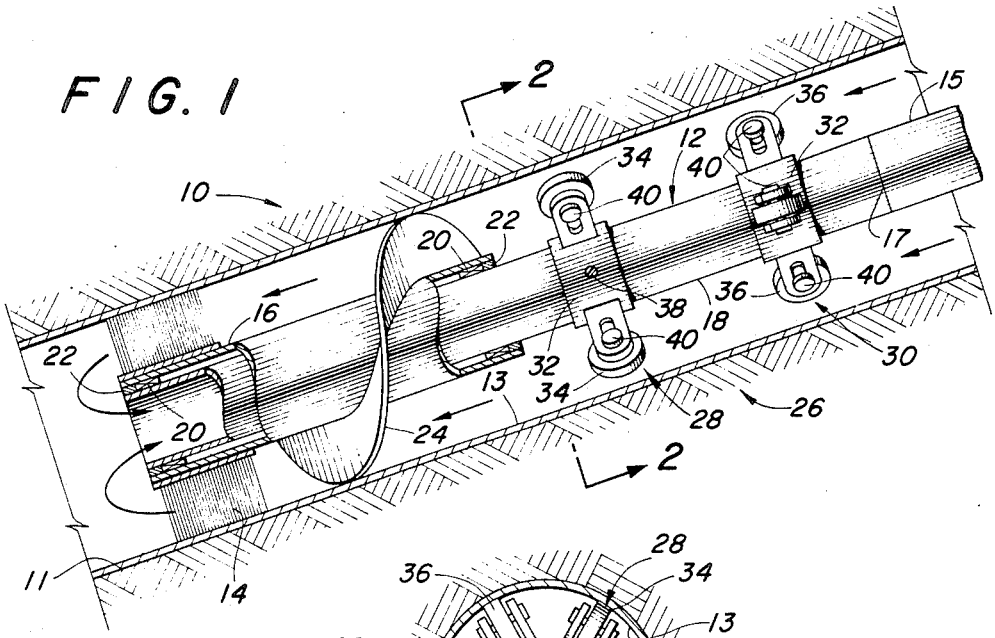
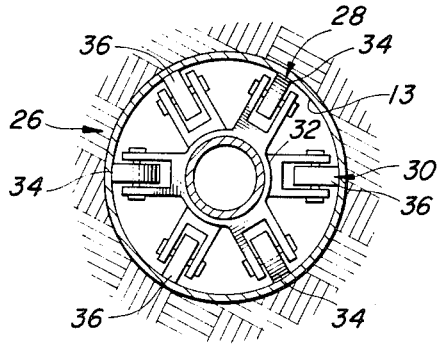
FIG. 2
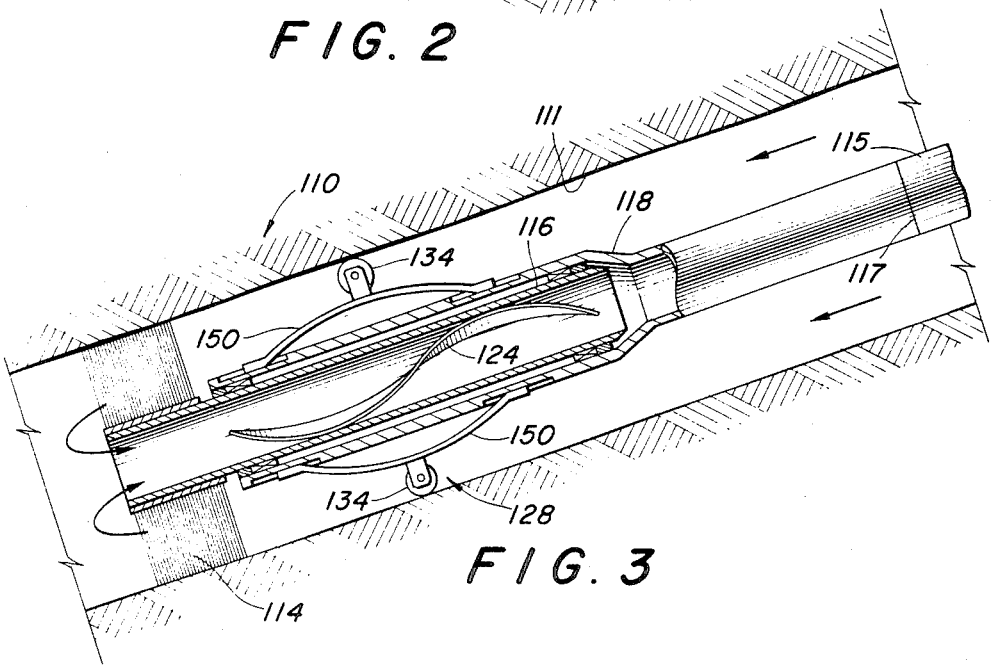
FIG. 3

WELLBORE CLEANING DEVICE

BACKGROUND AND SUMMARY OF THE INVENTION

1. Field of the Invention

The present invention relates to a method and an apparatus for cleaning out a wellbore prior to running casing. More particularly, the present invention is adapted for cleaning out caked cuttings which have gravitationally settled out of the mud returns in a highly-inclined wellbore.

2. Summary

A recent trend in the area of oil well drilling is to drill high angle, extended reach wellbores in order to enhance the effectiveness of the well in draining the reservoir. These horizontal and nearly horizontal wellbores create special problems with respect to handling of the mud returns.

In drilling a wellbore, particularly a wellbore with a high angle of inclination from the vertical, a need arises to clean out the wellbore prior to running casing. This is true in both cased and uncased wellbores. With conventional circulation techniques (i.e., down the drill string, out the cutter bit, back up the annulus) in these high angle bores, cuttings tend to gravitationally settle out of the mud returns, and cake on the bottom of either the newly cut portion of the bore or of a formerly cased section. When the next section of casing is run, the caked cuttings will be pushed along by the leading edge of the casing producing a wall of cuttings that will eventually jam, preventing the casing from being run to its intended depth. Further, settled cuttings can cause problems with running the drill string and/or logging tools into and out of the hole.

The present invention comprises a method and apparatus for cleaning out a cased or uncased wellbore (particularly a high angle wellbore) prior to running a(nother) string of casing or logging tool into the hole. A stiff-bristled scouring brush is run in the hole on the leading end of a drill string. Means is provided for rotating the brush as it is advanced through the section of the wellbore to be cleaned to enhance dislodgement of the caked on cuttings, mud, etc. Drilling fluid is reverse-circulated down the casing to entrain the dislodged material and sweep it uphole in the high velocity stream inside the drill string. A dolly helps maintain the cleaning apparatus centered in the wellbore. A resilient spring mounting may be provided for the casters of the dolly to enable them to better accomodate diameter variations of an uncased well.

Various characteristics, advantages and features of the method and apparatus will become apparent after a reading of the following description.

BRIEF DESCRIPTION OF THE DRAWING

FIG. 1 is a cutaway schematic side elevation of a first embodiment of the wellbore cleaning apparatus of the present invention preferred for usage in an angulated cased hole;

FIG. 2 is a cross-sectional view showing the centering dolly of the cleaning apparatus of the first embodiment of the present invention as seen along line 2—2 of FIG. 1;

FIG. 3 is a cutaway schematic side elevation of a second embodiment of the wellbore cleaning apparatus of the present invention preferred for usage in an angulated uncased hole;

DETAILED DESCRIPTION OF THE PREFERRED EMBODIMENTS

Figure 5:
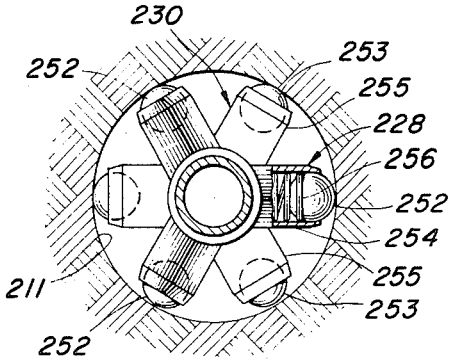
FIG. 5 is a cross-sectional view as seen on line 5—5 of FIG. 4 showing the centering dolly of the third embodiment of the present invention.

A first embodiment of the cleaning apparatus of the present invention is shown in FIG. 1 generally at 10. A high angle wellbore 11 has liner or casing 13 extending along and forming its internal diameter. As additional drilling of the wellbore is done, the cuttings gravitationally settle out of the mud returns being circulated upwardly (to the right in FIG. 1) and become caked on the inside of casing 13. These cuttings can cause problems not only with the manipulation of the drill string but also with insertion and retraction of well-logging tools and may cause jamming when the next string of casing is inserted.

To alleviate this problem, a section 12 is threaded onto the leading end 17 of drill string 15 in the same manner as a drill bit, or the like. A stiff-bristled scouring brush 14 is fixed to a first portion 16 of end section 12. First portion 16 is rotatably mounted on a second fixed portion 18 by means of bearings 20. Seals 22 prevent fluid flow between first portion 16 and second portion 18. Seals 22 are low-pressure, low-friction seals so as not to provide resistance to rotation of rotary brush 14. A helical impeller 24 is mounted along the external periphery of first portion 16. The outer diameter of impeller 24 is substantially equal to the inner diameter of casing 13.

A centering dolly 26 is comprised of a series (only two shown) of caster members 28 and 30 mounted upon the surface of second portion 18 by a band 32. Caster members 28 and 30 are preferably each comprised of three casters, or in this case, wheels 34 and 36, respectively. As seen in FIG. 2, the wheels of successive caster members are preferably offset with respect to the preceeding set for better load support and improved centering. Mounting band 32 may be secured in position about the periphery of second portion 18 (and drill string 15, if desired) by one or more set screws 38. Bands 32 might also be tack welded in place, if desired. Preferably, a resilient bushing 40 provides some resiliency in the mounting to permit flexing for transiting curves, or the like. Alternatively, a leaf spring (not shown) could be used to bias the wheels 34 and 36 outwardly and permit the wheels to flex inwardly as necessary. Although only two sets of caster members have been shown, it will be appreciated that as many sets as necessary to support the weight of the particular diameter drill string and keep the cleaning apparatus centered in casing 13 may be used.

In operation, cleaning apparatus 10 is attached to the leading end 17 of drill string 15 and run into the hole to the portion of wellbore casing 13 needing cleaning. Centering dolly 26 keeps the cleaning apparatus 10 positioned in the casing 13 and prevents the weight of drill string 15 from riding on brush 14 and impeller 24. A pump (not shown) at the surface forces drilling fluid down the casing outside the drill string. Casing 13 reverse circulates the drilling fluid past helical impeller 24, and the hydraulic pressure of the drilling fluid causes the first portion 16 to rotate on bearings 20 relative to non-rotating second portion 18. Low-pressure, low-friction seals 22 prevent the drilling fluid from bypassing impeller 24. It will be appreciated that although only a single convolution of a single vane has been shown, the impeller 24 may take whatever configuration desired (i.e., as the specific downhole conditions impact the design parameters of the vane necessitating changes to insure the desired rotation).

The rotary securing brush 14 knocks loose the caked on cuttings from the interior of casing 13 and the reverse-circulated drilling fluid entrains the dislodged material and carries it upwardly through drill string 15. A static head of drilling fluid standing in the wellbore below the brush helps to force the cuttings-laden stream back up the drill string 15. Since the low pressure, high volume of drilling fluid is being forced into the smaller diameter drill string 15, the return flow of fluid will be at a significantly higher velocity which will decrease the chances of the cuttings settling out of the return stream.

A second embodiment is depicted in FIG. 3 generally at 110 in which like elements bear a similar reference numeral preceded by the numeral --1--. Rotary scouring brush 114 is particularly adapted for usage in a cased-/uncased wellbore to clean out both the cased portion and the newly drilled uncased wellbore 111 extending beyond the casing. The uncased wellbore 111 will generally have significant variations in diameter resulting from the drilling action. In order to accomodate such diameter variations, wheels 134 are mounted on bow springs 150 that can expand and contract as the diameter of the hole demands. Although the support casters are preferredly deployed in the three equally spaced configuration of FIG. 1, these casters may be arranged in other configurations, for example, the quadrilateral arrangement depicted in FIG. 3. Further, casterw 128 (only one shown) are moved closer to the scouring brush 114. Helical impeller 124 is mounted internally of first portion 116 which telescopes within rather than over the second portion 118 of section 112. The operation of the second embodiment is identical in all other respects to that of the first embodiment.

Figure 4:
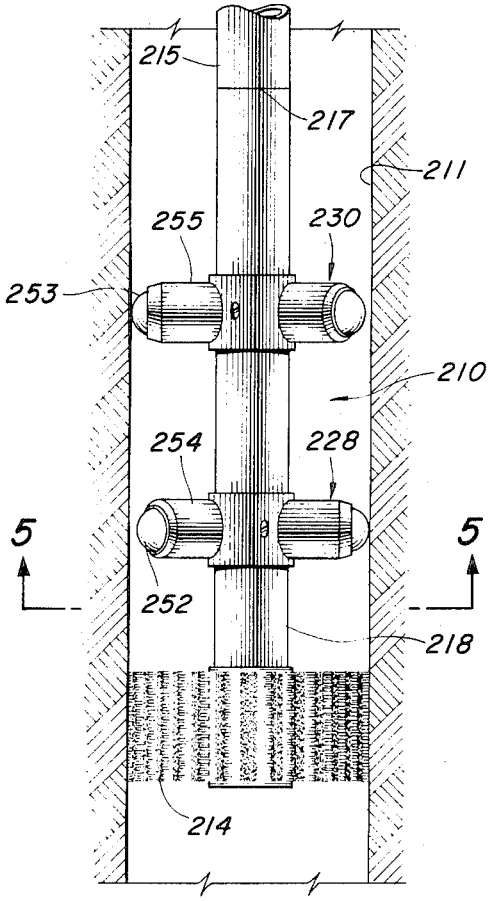
FIG. 4 is a cutaway schematic side elevation of a third embodiment of the wellbore cleaning apparatus of the present invention preferred for usage in a generally vertical hole for mud cleanout prior to running and cementing casing in place.

Yet, a third embodiment is depicted in FIGS. 4 and 5 generally at 210. Like elements have like reference numerals preceded by the numeral --2--. This embodiment is particularly adapted to cleaning caked mud out of an uncased wellbore 211 prior to running and cementing casing. Pockets of caked drilling fluid or mud can deleteriously affect a cementing job by creating channels through which well fluids can travel through the wellbore outside the casing. This can especially occur where the drilled hole becomes elliptical and the mud packs into the ends of the ellipse next to the casing inspite of efforts to dislodge it by reciprocating casing during cementing. In this embodiment, the scouring brush 214 is fixed directly on the non-rotating "second" portion 218 (there actually is no second portion in this embodiment because there is no rotating first portion equivalent to 16 or 116) and the brush is rotated by rotating drill string 215 as in a typical drilling operation.

Caster members 228 and 230 comprise a plurality of spherical rollers 252 and 253 within mountings 254 and 255, respectively, biased outwardly by a spring 256 or the like, said rollers 252 and 253 accomodating both the longitudinal and rotary movement of the casing 211 (i.e., casters 254 and 255 accomodate at least two degrees of rotational freedom for rollers 252). Spring 256 permits the rollers to accomodate variations in the diameter of uncased wellbore 211. As the brush 214 is advanced through the vertical uncased wellbore 211, the drill stem will wobble in the bore (in the same manner the drill bit did when forming the hole) making it possible for brush 214 to sweep caked mud from out of an ends of the elliptical hole.

Various changes, alternative and modifications will become apparent to a person of ordinary skill in the art following a reading of the foregoing specification. For example, although each of the three preferred embodiments have features that specifically adapt it for a particular usage, it will be appreciated that each embodiment could be utilized in either of the other two applications with some reduction of efficiency. Accordingly, it is intended that all such changes, alternatives and modifications as come within the scope of the appended claims be considered part of the present invention.

I claim:

1. A method of dislodging and removing cuttings which have settled out of a mud stream and become caked on a lower portion of a wellbore when drilling a highly-angulated wellbore, said method comprising:

inserting a scouring brush into said wellbore on a leading end of a drill string, said drill string having substantial weight per unit length;

advancing said scouring brush through a portion of the highly-angulated wellbore to be cleaned;

rotating said brush during advancement to enhance dislodgement of said caked cuttings, and the like, from said lower portion of said wellbore;

supporting said rotating brush in a position that is generally centered within the wellbore so as not to permit the weight of said drill string to ride on said brush;

reverse-circulating drilling fluid in said highly-angulated wellbore in order to entrain said recently dislodged cuttings and carry them upwardly out of said wellbore through said drill string before they have a chnace to once again settle out of the mud stream;

said rotating of said brush being performed, at least in part, using said reverse circulating fluid to produce a hydraulic pressure for rotationally driving said brush.

2. Apparatus for cleaning out a portion of an internal surface of a highly-angulated wellbore prior to running a string of casing in order to dislodge cuttings which have gravitationally settled out of a mud stream and become caked on a lower portion of said wellbore, said apparatus comprising:

a scouring brush means affixed to a leading end of a drill string, said drill string having substantial weight per unit length;

means for advancing said scouring brush means through a portion of the highly-angulated wellbore to be cleaned;

a helical driving surface affixed to said scouring brush means for rotating said scouring brush means during advancement to enhance dislodgement of said caked cuttings, and the like, from said lower portion of said wellbore;

means for supporting said brush means in a position that is generally centered within the wellbore so as not to permit the weight of said drill string to ride on said brush;

means to reverse circulate drilling fluid in said highly-angulated wellbore to entrain said recently dislodged cuttings and carry them upwardly out of said wellbore through said drill string.

3. The apparatus of claim 2 wherein said means for supporting said brush means comprises dolly means mounted about the drill string periphery.

4. The apparatus of claim 3 wherein said dolly means comprises a plurality of sets of caster members.

5. The apparatus of claim 4 wherein each set of caster members comprise three casters equally spaced about said drill string periphery.

6. The apparatus of claim 5 wherein the casters of a second set of said plurality of sets of caster members are laterally offset with respect to the casters of a first set of caster members.

7. The apparatus of claim 5 wherein each of such casters is resiliently mounted to permit accomodation for dimensional variations in said wellbore.

8. The apparatus of claim 5 wherein each of said casters comprises a wheel with a rotational axis that extends generally orthogonally to the longitudinal axis of said drill string.

9. The apparatus of claim 5 wherein each of said casters comprises a free-floating sphere mounted in and partially extending from a housing permitting said sphere at least two degrees of rotational freedom in order to facilitate the translational and rotational movement of said scouring brush means.

10. The apparatus of claim 2 wherein said helical driving surface is affixed to an external surface of said scouring brush means.

11. The apparatus of claim 2 wherein said helical driving surface is affixed to an internal surface of said scouring brush means.

12. The apparatus of claim 2 wherein said means for rotating said scouring brush means further comprises said drilling fluid which has sufficient hydraulic pressure when directed into contact with said helical driving surface as to rotate said scouring brush means.

13. The apparatus of claim 2 comprising an end section with a first portion which fixedly mounts said brush means at least said first portion of said end section being rotatable with respect to a second non-rotatable portion of said drill string.

14. The apparatus of claim 13 further comprising bearing means between said rotatable and non-rotatable portions to facilitate rotation of said brush means.

15. The apparatus of claim 14 further comprising seal means for inhibiting flow of said drilling fluid between said rotatable and said non-rotatable portions.

16. The apparatus of claim 15 wherein said seal means comprises at least one low-pressure, low-friction seal member.

17. Apparatus for cleaning out a portion of an internal surface of a highly-angulated wellbore prior to running a string of casing in order to dislodge cuttings which have gravitationally settled out of a mud stream and become caked on a lower portion of said wellbore, said apparatus comprising:

a scouring brush means affixed to a first leading end portion of a drill string, said drill string having substantial weight per unit length and said first leading end portion being rotatable with respect to a second non-rotatable portion of said drill string;

means for advancing said scouring brush means through a portion of the highly-angulated wellbore to be cleaned;

means for rotating said scouring brush means during advancement to enhance dislodgement of said caked cuttings, and the like, from said lower portion of said wellbore;

means for supporting said brush means in a position that is generally centered within the wellbore so as not to permit the weight of said drill string to ride on said brush;

means to reverse circulate drilling fluid in said highly-angulated wellbore to entrain said recently dislodged cuttings and carry them upwardly out of said wellbore through said drill string.

18. The apparatus of claim 17 wherein said means for rotating said scouring brush means comprises a helical driving surface affixed to said first leading end portion.

19. The apparatus of claim 18 wherein said means for rotating said scouring brush means comprises, at least in part, said reverse-circulated drilling fluid which, when directed against said helical driving surface, has sufficient hydraulic pressure to rotate said scouring brush means.

20. The apparatus of claim 17 wherein said helical surface is affixed to an external surface of said first leading end portion.

* * * * *